United States Patent [19]

Francis

[11] Patent Number: 4,684,075

[45] Date of Patent: Aug. 4, 1987

[54] TOILET PAPER DISPENSER

[76] Inventor: Gilbert Francis, 245 North Street, Stouffville, Ontario, Canada, L0H 1L0

[21] Appl. No.: 904,102

[22] Filed: Sep. 4, 1986

[51] Int. Cl.[4] ..... B65H 16/00; B65H 19/12

[52] U.S. Cl. ..... 242/55.42; 242/55.53

[58] Field of Search ..... 242/55.42, 55.3, 55.53; 312/45, 72, 73; 225/45, 46

[56] References Cited

U.S. PATENT DOCUMENTS

| | | | |
|---|---|---|---|
| 1,057,973 | 4/1913 | Merritt | 242/55.3 |
| 2,758,800 | 8/1956 | McCants | 242/55.3 |
| 2,991,951 | 7/1961 | Carroll | 242/55.42 |
| 3,295,777 | 1/1967 | Carroll | 242/55.3 |
| 3,865,295 | 2/1975 | Okamura | 242/55.3 |
| 4,363,454 | 12/1982 | Mohar | 242/55.53 |

FOREIGN PATENT DOCUMENTS

| | | | |
|---|---|---|---|
| 623434 | 7/1961 | Canada . | |
| 7503242 | 9/1976 | Netherlands | 242/55.3 |

*Primary Examiner*—John M. Jillions
*Assistant Examiner*—Steven duBois
*Attorney, Agent, or Firm*—Ridout & Maybee

[57] ABSTRACT

A paper roll dispenser is provided within a housing adapted to be wall mounted. The dispenser comprises a vertically disposed open ended tube mounted inside the housing which is adapted to receive a plurality of rolls of paper. The bottom end of the tube is laterally spaced from the floor of the housing by a distance greater than the height of a roll of paper. The first lever is mounted and biased to a position directly underneath the bottom of the housing to prevent rolls of paper in storage from falling out of the tube, but is pivotal about a vertical axis to clear the bottom of the tube and thus allow a new roll of paper to drop down. A second lever is spaced a distance up the tube to pass into a slot defined in the tube at a level intersecting the second roll of paper from the bottom of the tube. The second lever is biased to clear the tube but is pivotal about a vertical axis to enter the aperture. The first and second levers are connected so that pivoting of the first lever to clear the tube pivots the second lever into the aperture bearing against the second roll of paper in storage. By the co-operating action of the two levers, only one roll of paper drops from storge at a single time.

11 Claims, 7 Drawing Figures

TOILET PAPER DISPENSER

FIELD OF THE INVENTION

The present invention relates to a paper roll dispenser, and is particularly applicable to the dispensing of rolls of toilet paper.

BACKGROUND OF THE INVENTION

Toilet roll dispensers, having the storage capacity for a plurality of rolls of paper, have generally been found useful, especially in commercial applications, such as public washrooms and the like. It is very important that an adequate supply of toilet tissue be present at all times. However, it is not desirable that several loose rolls of toilet paper be left lying around, since this is unsightly, and can easily cause considerable clutter. Also, patrons are not encouraged to complete one roll of paper before starting the next roll.

In order to avoid having a washroom attendant constantly checking for an adequate supply of paper, enclosed storage devices for a plurality of rolls of paper have been developed, whereby only one roll of paper will be in use at a time, but additional supplies are close to hand if needed.

Examples of such storage dispensers are illustrated and described in U.S. Pat. Nos. 2,991,951 and 3,295,777, both to Carroll, and also Canadian patent No. 623,434—Klarenbach. All three devices include a vertical storage unit which ranks the rolls of paper in storage, held in place by a plate obstructing the opening at the bottom of the unit.

On completion of the roll of paper "in use", the plate can be removed from the opening and a new roll of paper dispensed. However, the user must either be nimble-fingered or have timely reflexes to return the plate to obstruct the opening and to prevent more than one roll being dispensed at a time. The hapless user who cannot act quickly enough or does not realise what is required, will find a second roll of paper dropping on top of the first fresh roll, and this will obstruct unwinding of the fresh roll. The only way to return the second roll back into the storage unit and return the plate to its position obstructing the bottom of the storage unit is by much inconvenient manipulation and poking about.

It is an object of the present invention to provide a novel paper storage device which allows storage of a plurality of rolls, but is simple to use and sure to release only a single fresh roll of paper at one time.

It is also an object of the present invention to provide convenience, in the provision both of ready reserve supplies of paper, and also in the provision of a convenient telephone hook-up.

SUMMARY OF THE INVENTION

The present invention is therefore directed to an improved apparatus for storing and dispensing rolls of paper.

In one embodiment, a paper roll dispenser is provided consisting of a housing adapted to be wall mounted, having back and side walls, a floor and a hinge front wall. A vertically disposed open ended tube adapted to receive a plurality of rolls of paper is mounted inside the housing spaced from the floor of the housing a distance greater than the height of a roll of paper, and the tube has defined on its side a horizontal slot spaced from the bottom of the tube a distance between the height of a single roll and two rolls of paper. A first lever is mounted inside the cabinet and is biased to obstruct the bottom end of the tube. The first lever is pivotal about a vertical axis to clear the bottom of the tube. A second lever, also mounted inside the cabinet, is biased to clear the tube and pivotal about a vertical axis to enter the horizontally disposed slot and bear against the roll in the tube, on pivoting of the first lever.

Preferably, a third lever is also provided which is biased to bear against the roll of paper receivably located on a spigot rigidly projecting from the floor of the housing for receivably locating a roll of paper dropped from the tube. Engagement means connect the three levers so that pivoting of the third lever against its bias pivots the first and second levers against their respective biases.

In another aspect of the invention, means are provided for mounting a telephone on the cabinet with the paper roll dispenser.

DETAILED DESCRIPTION OF A PREFERRED EMBODIMENT

Figure 1:
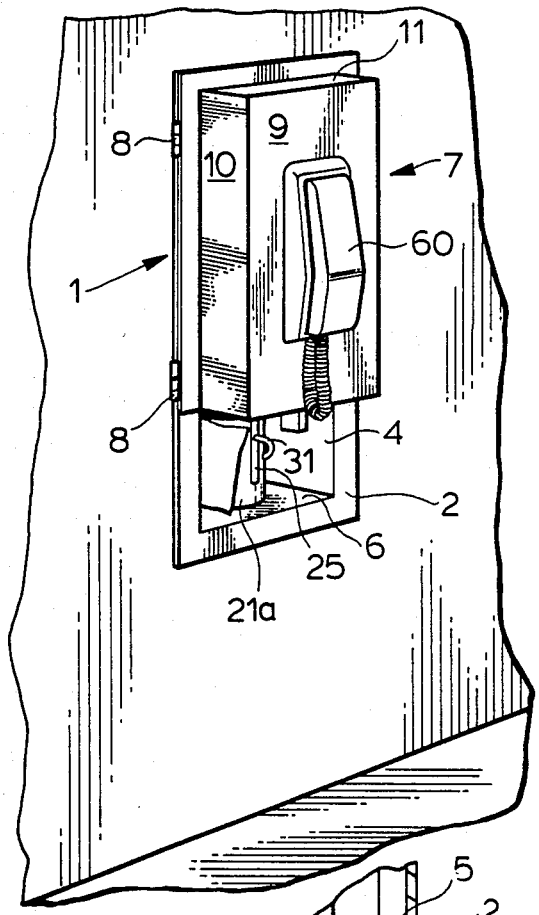
FIG. 1 is a front perspective view of one embodiment of a wall-mounted toilet-paper dispenser, according to the invention.
Figure 2:
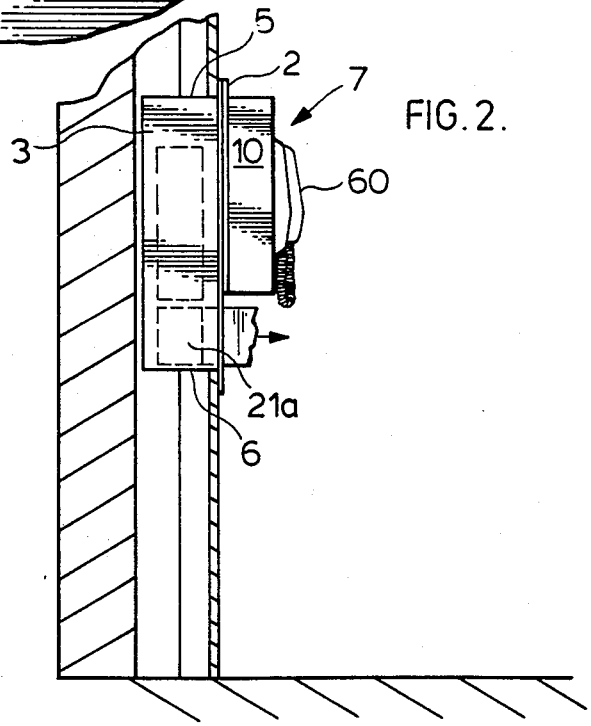
FIG. 2 is a side view of the embodiment of the invention shown in FIG. 1, taken through a section of the mounting wall.

As shown in FIGS. 1 and 2, a housing 1 is provided to contain the dispenser according to the invention and facilitate wall mounting. The housing 1 consists of a peripheral frame 2 enclosing a recessed cabinet having a back wall 3, opposed side walls 4, a top wall 5 and a bottom wall 6.

A cover 7 is mounted on frame 2 by hinges 8 on one side, and partially encloses the recessed cabinet when in closed position. Separate lock means, such as bolts **7*a* receibable in apertures 7*b* may be provided on the opposed sides of frame 2 for securing cover 7 closed, but cover 7** may be opened as required for replenishing the supply of paper associated with the dispenser, as required.

Figure 3:
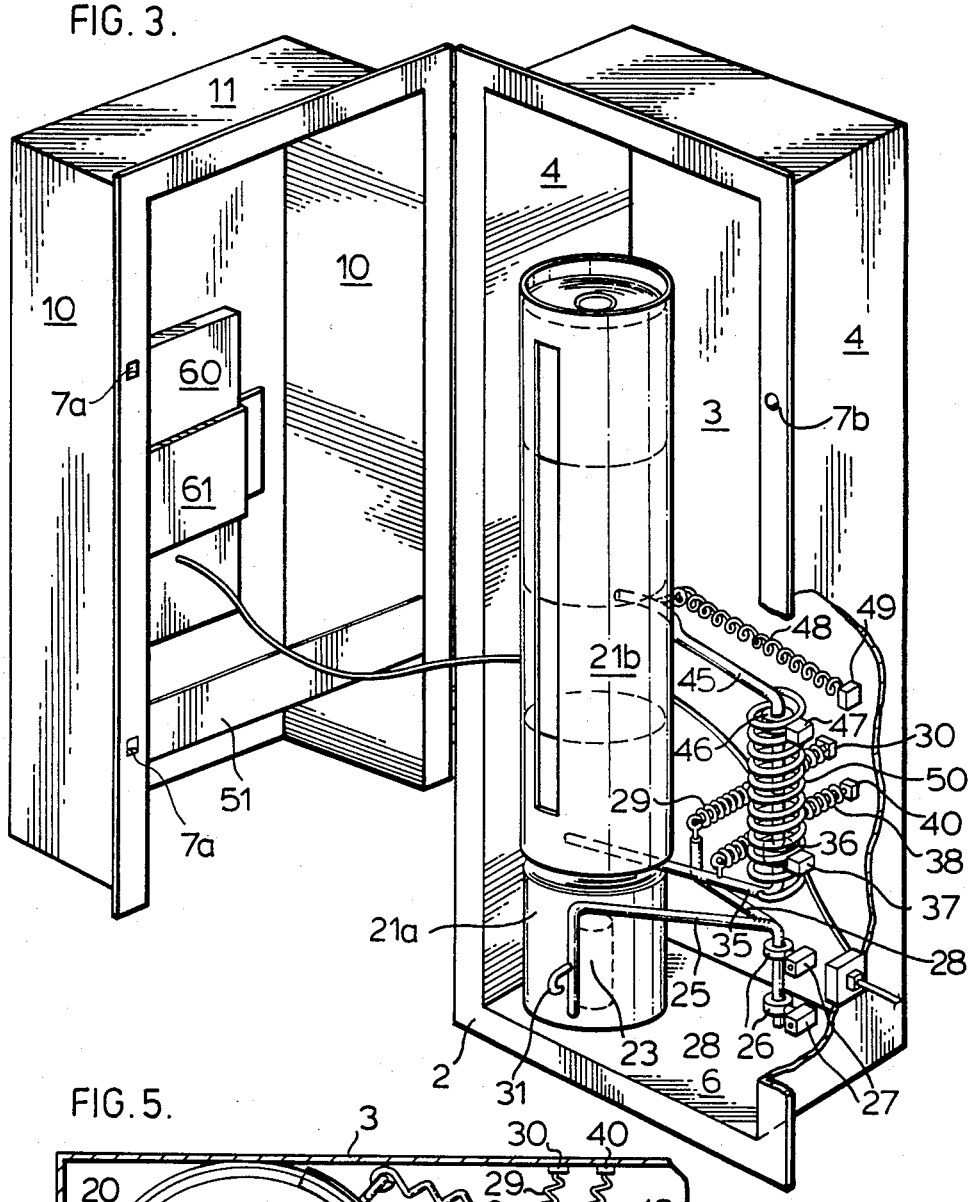
FIG. 3 is an interior front perspective view in partial cutaway.

As shown in FIGS. 1 to 3, cover 7 is of box-like construction, having face wall 9 extended outwardly by opposed side walls 10 and top wall 11 to provide an inner cavity in which the dispensing mechanism can freely operate.

For a cleaner architectural appearance, it is preferable that the side walls 10 and top walls 11 of the cover 7 meet flush with their respective counterparts, side walls 4 and top wall 5 of the recessed cabinet.

The internal dispensing mechanism itself is illustrated in FIGS. 3 through 6.

In FIG. 3, a vertically open ended tube 20 is mounted on back wall 3 of the recessed cabinet.

Figure 4:
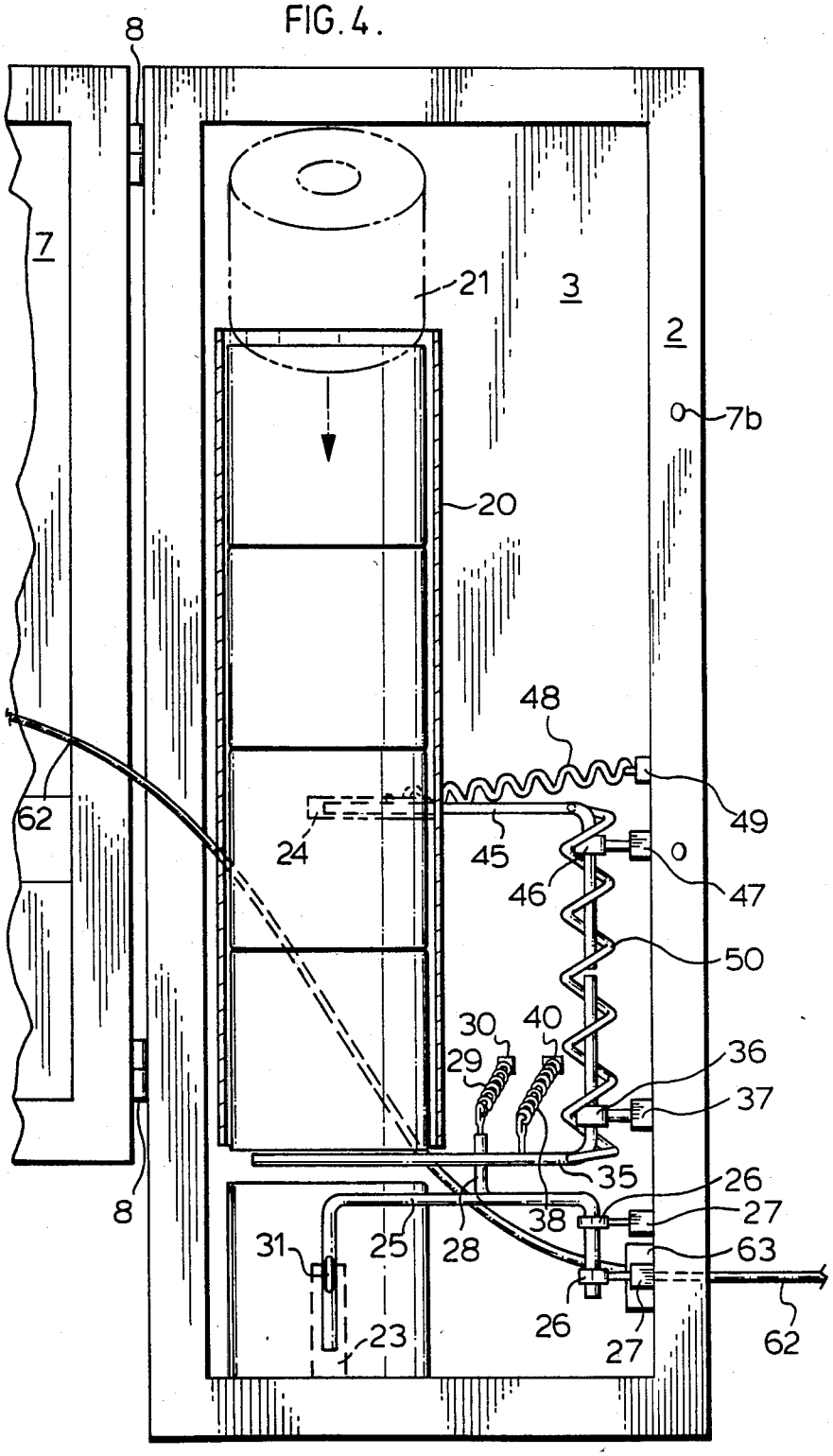
FIG. 4 is a lateral cross-sectional view of the dispenser.

As shown in FIG. 4, tube 20 is of suitable interior dimensions to accommodate the circumference of a standard roll of paper 21 with slight leeway so that rolls of paper can freely slide down the length of tube 20.

A frontally disposed vertical aperture 22 is defined along the length of tube 20 to allow determination of the number of rolls of paper in the tube at any time by quick visual inspection.

A horizontal slot 24 is defined in one side of the tube 20. Slot 24 is disposed from the bottom of tube 20 at a height between the heights of one and two rolls of paper, so that the slot will normally intersect the roll of paper immediately above the lowest roll in the tube.

Tube 20 is mounted in the cabinet at a distance from bottom wall 6 of the recessed cabinet greater than the height of a standard roll of paper.

Spigot 23 rigidly projects from the bottom wall 6 of the recessed cabinet, and is preferably somewhat centred in relation to the open end of tube 20 above it.

Lever 25 is mounted through eyes 26 which are affixed on blocks 27 to one side wall 4 of the recessed cabinet, thereby pivoting about its vertical axis. Lever 25 is spring biased toward the back wall 3 by the pull of arm 28 upwardly projecting from lever 25 and attached to spring 29 which projects from block 30 mounted on the back wall 3.

Lever 25 is provided with handle 31 projecting outwardly to allow manual pivoting of the lever 25.

Lever 35 is pivotally mounted through eye 36 at a level to marginally clear the bottom of tube 20. Eye 36 is in turn mounted on block 37 affixed to side wall 4. Lever 35 is also pulled toward rear wall 3 by spring 38 mounted on rear wall 3 at block 40, but is obstructed by arm 28 which intersects it.

Lever 45 is pivotally mounted at the level of horizontal slot 24 on side wall 4 through eye 46 and block 47. Lever 45 is also spring biased toward rear wall 3, through the pull of spring 48 mounted on side wall 4 with block 49. Spring 48 is arranged to be at minimum contraction when lever 45 clears horizontal slot 24 in tube 20.

Spiral spring 50 is connected with lever 35 at its bottom end and lever 45 at its top end, and acts to transfer movement between the two levers.

Pocket 51 is provided inside cover 7 for storing articles such as sanitary napkins.

In operation, tube 20 contains several reserve rolls of paper. The lead roll of paper in use **21*a* is inserted over spigot 23 and rests on bottom wall 6**.

Figure 5:
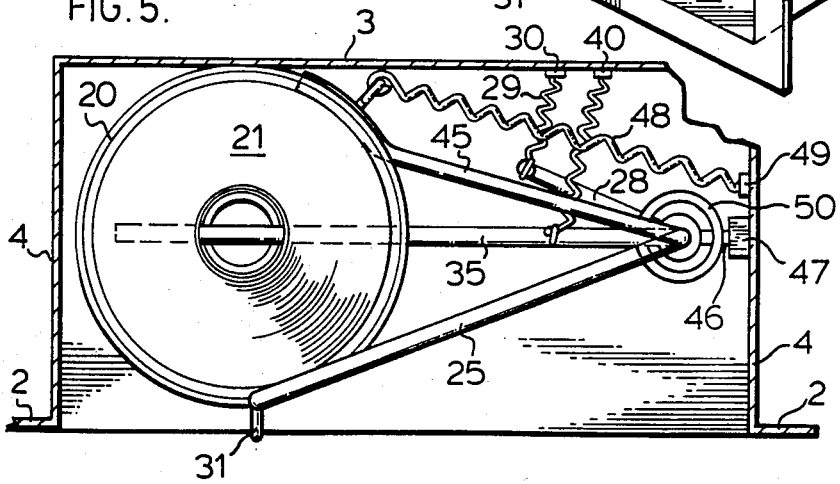
FIGS. 5, 6 and 7 are top plan views showing operation of the dispenser.

As shown in FIGS. 3 and 5, lever 25 normally rests pressing slightly against the lead roll of paper **21*a***, preventing uncontrolled unrolling or unravelling of the paper.

Lever 35, passing directly under the open bottom end of tube 20, obstructs the opening, holding the rolls of paper in reserve in the tube.

Figure 7:
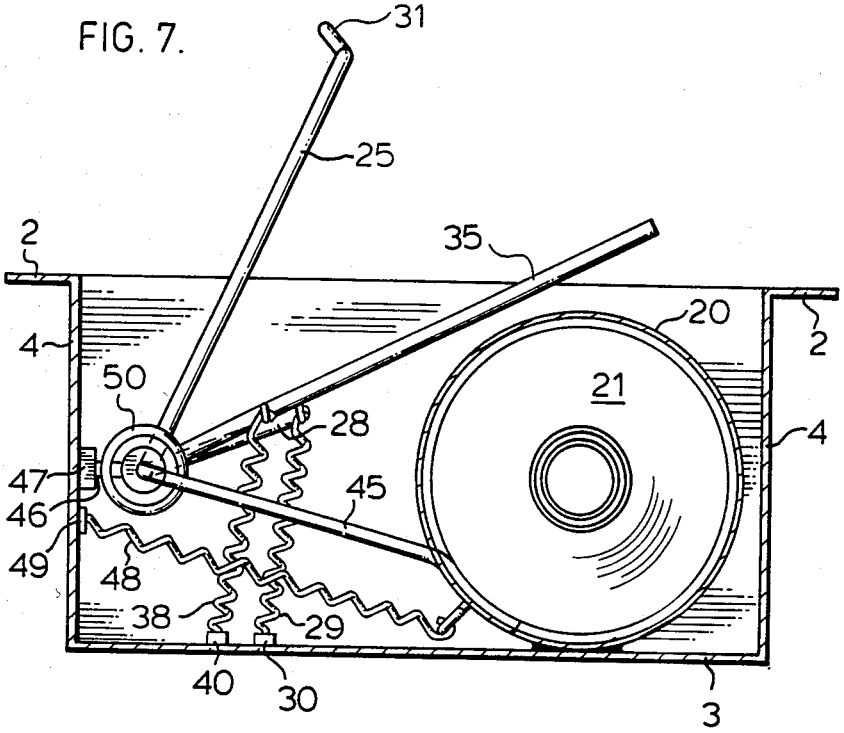
Figure 6:
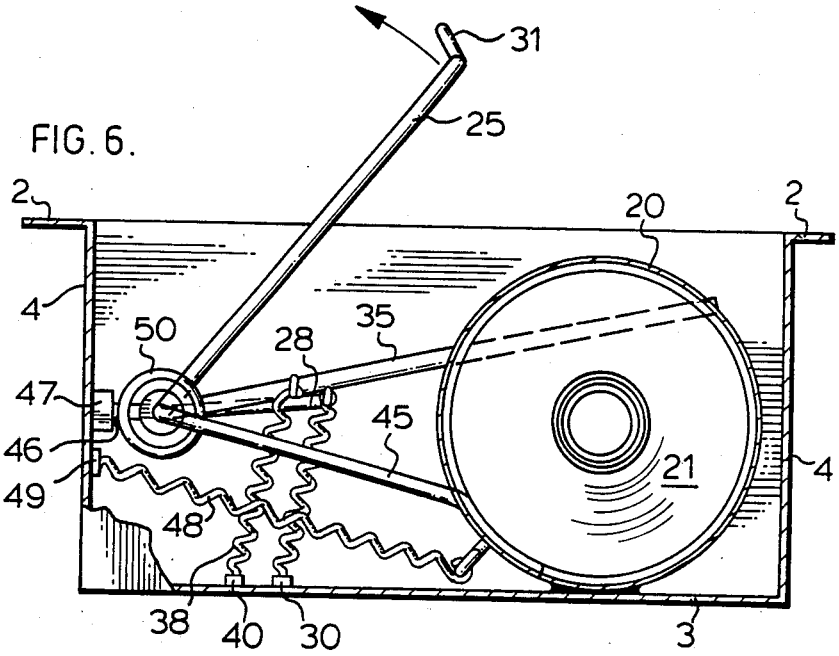

When the lead roll of paper **21*a* has been exhausted, its cardboard core can be torn away from spigot 23. As shown in FIGS. 6 and 7 respectively, the user pulls manually on handle 31 to pivot lever 25 forward from spigot 23. Arm 28 engages lever 35 and pulls it forward to remove the obstruction from the bottom opening of tube 20, allowing a fresh roll of paper to drop onto spigot 23**.

Due to the transmitting action of spiral spring 50, lever 45 is pulled forward simultaneously with lever 35 and enters horizontal slot 24 bearing against the second reserve roll of paper **21*b* in tube 20 (see FIG. 3). Preferably, the free end of lever 45 is arc-shaped to provide even bearing against a larger circumference of the roll. The second reserve roll of paper 21*b* is thus held in place (holding the remaining reserve rolls above it) and thus only one roll of paper drops from tube 20**.

Once the user releases handle 31, both of levers 25 and 35 return to their original positions by spring action, lever 35 having the freedom to spring back only as far as permitted by the obstruction of arm 28.

The movement of lever 35 again transfers through spiral spring 50 releasing lever 45 to spring back to its original position. Reserve roll **21*b*, no longer obstructed by the bearing of lever 45 falls to the bottom of tube 20 to rest against lever 35**.

Another aspect of the invention is the combination of telephone mountings with the paper dispenser.

As shown in FIGS. 1 and 2, a standard wall mounting telephone 60 may be mounted on front face 9 of cover 7. As shown in FIG. 3, telephone 60 is received through a rectangular aperture in front face 9, and the telephone 60 secured in place with telephone bracket 61 attached at the back. Telephone cord 62 extends from the rear of the telephone 60 for insertion into jack 63 mounted in either a side wall 4 or the back wall 3 of the recessed cabinet. It is important that sufficient play of telephone cord 62 be provided to allow free opening and closing of cover 7.

I claim:

1. A paper roll dispenser, comprising:

a housing adapted to be wall mounted, having back and side walls, a floor and a hinged front wall;

a vertically disposed open ended tube adapted to receive a plurality of rolls of paper mounted inside the housing, a bottom end of the tube being laterally spaced from the floor of the housing by a distance greater than the height of a roll of paper, the tube having defined in a side wall thereof a slot spaced from the bottom of the tube by a distance more than the height of a single roll and less than the height of two rolls of paper;

a first lever mounted inside the housing biased to obstruct the bottom end of the tube and pivotal about a vertical axis to clear the bottom of the tube; and a second lever mounted inside the cabinet, and connected with said first lever and means to bias said second lever to clear the tube, said second lever being pivotal about a vertical axis to enter said slot and bear against a roll in the tube on pivoting of the first lever to clear the bottom of the tube.

2. A paper roll dispenser, according to claim 1 wherein the pivotal axis of the first and second levers are co-axial and are connected by a spiral extending along their common pivotal axis.

3. A paper roll dispenser, according to claim 1, further comprising a spigot rigidly projecting from the floor of the housing for receiving a roll of paper dropped from the tube.

4. A paper roll dispenser, according to claim 3, further comprising:

a third lever mounted inside the cabinet, biased to bear against the periphery a roll of paper received by the spigot and pivotal about a vertical axis to clear said periphery; and engagement means connecting the three levers whereby pivoting of the third lever against its bias pivots the first and second levers against their respective biases.

5. A paper roll dispenser, according to claim 1 or 4, wherein the levers each have individual bias springs.

6. A paper roll dispenser, according to claim 4, wherein the third lever is provided with a forwardly projecting handle to facilitate manual pivoting of said third lever against this bias.

7. A paper roll dispenser, according to claim 1 or 4, wherein the levers are all detachably mounted by means releasable from inside the housing.

8. A paper roll dispenser, according to claim 1, wherein the tube has defined therein a frontal vertical slot long enough to expose at least part of each roll contained within the tube.

9. A paper roll dispenser, according to claim 1, further comprising lock means for securing the hinged front wall closed against said side walls.

10. A paper roll dispenser, according to claim 1, further comprising means for mounting a telephone on the cabinet.

11. A paper roll dispenser according to claim 10 wherein the means for mounting a telephone on the cabinet comprise:

a telephone bracket centrally mounted on the hinged front wall;

a telephone connecting jack mounted inside the cabinet; and cord means for connecting the telephone bracket with the telephone connecting jack.

* * * * *